US006032955A

United States Patent [19]

Luciano et al.

[11] Patent Number: 6,032,955

[45] Date of Patent: Mar. 7, 2000

[54] PROGRESSIVE WAGERING SYSTEM WITH JACKPOTS DISPLAYED IN TANGIBLE OBJECTS

[75] Inventors:

Robert A. Luciano; Ian F. Burns, both of Reno, Nev.

[73] Assignee: Sierra Design Group, Reno, Nev.

[21] Appl. No.: 09/018,086

[22] Filed: Feb. 3, 1998

[51] Int. Cl.[7] ..... A63F 9/24; G09F 17/34

[52] U.S. Cl. ..... 273/138.1; 273/138.2; 273/143 R; 463/25; 463/26; 463/27; 463/20

[58] Field of Search ..... 273/138.2, 138.1, 273/143 R, 121 B, 447, 454; 463/46, 25, 26, 27, 20

[56] References Cited

U.S. PATENT DOCUMENTS

| | | | |
|---|---|---|---|
| 5,386,995 | 2/1995 | Takemoto et al. | 273/148 R |
| 5,397,125 | 3/1995 | Adams | 273/138.2 |
| 5,564,700 | 10/1996 | Celona | 463/27 |

*Primary Examiner*—Benjamin H. Layno
*Attorney, Agent, or Firm*—Ian F. Burns

[57] ABSTRACT

A progressive wagering system in which all or a portion of the value of a progressive jackpot is displayed with prize objects. A bank is provided for storing, displaying, and dispensing the prize objects. A plurality of wagering devices are linked to the bank for allowing players to place wagers and participate in a progressive wagering game. A control device is provided for communicating with the wagering devices and controlling the coin bank. By conspicuously displaying at least a portion of the progressive jackpot, the progressive wagering system increases excitement and enjoyment experienced by players.

22 Claims, 2 Drawing Sheets

PROGRESSIVE WAGERING SYSTEM WITH JACKPOTS DISPLAYED IN TANGIBLE OBJECTS

BACKGROUND OF THE INVENTION

1. Field of Invention

This invention relates to a linked progressive wagering system in which all or a portion of the value of progressive jackpot is displayed with tangible prize objects, such as coins.

2. Description of Related Art

Linked progressive wagering systems are well known in the art. In most of these systems a number of wagering devices are linked to a central computer. As wagers are placed in the wagering devices, a portion of each wager is contributed to at least one progressive jackpot or prize. As contributions are made to the progressive jackpot, the size of the jackpot grows until it is awarded to a player. The size of the jackpot is usually displayed in a numerical meter or sign.

What has long been needed in the field of linked progressive wagering games is a means for displaying progressive jackpots in the form of tangible prize objects, such as coins or tokens. It has been found that displaying a jackpot in tangible prize objects enhances the jackpot and increases excitement experienced by players. Graphical display devices fail to evoke the excitement, stimulation, and enjoyment that is possible with tangible objects.

SUMMARY OF INVENTION

1. OBJECTS OF THE INVENTION

It is an object of the present invention to provide a means for increasing visual stimulation in progressive wagering systems thereby increasing excitement and enjoyment experienced by players.

It is another object of the present invention to provide a progressive wagering system that displays at least a portion of the value of a progressive jackpot in tangible prize objects, such as coins or tokens.

It is a further object of the present invention to provide a progressive wagering system that awards at least a portion of the progressive jackpot to the player in the form of tangible prize objects.

It is a further object of the present invention to provide a progressive wagering system that is capable of awarding a jackpot that comprises goods or services.

It is another object of the present invention to provide prize objects for use in the progressive wagering system discussed above that represent goods or services.

These and other objects of the present invention may be realized by reference to the remaining portions of the specification, claims, and abstract.

2. BRIEF DESCRIPTION OF THE INVENTION

In accordance with the objectives of the present invention, the progressive wagering system of the present invention comprises a plurality of wagering devices and a prize object bank. The gaming devices are linked, either physically or through communication devices, to the bank. The gaming devices, which may be any of a large number of devices that are well known in the art, allow players to place wagers, activate games, and win jackpots based upon the outcome of the games.

Preferably, the bank is highly visible to players and spectators. By displaying the progressive jackpot in a highly visible manner, visual stimulation is increased and the wagering devices and the games offered on the wagering devices are enhanced. The bank may also comprise means for producing stimulating sounds, such as clinking from falling prize objects. Preferably, the progressive prize is displayed in coins or tokens. However, other objects may be used, such as paper currency, jewelry, precious stones, toys, trinkets, coupons, and vouchers.

The present invention also comprises a control device for controlling the system. The control device controls the number of objects that are deposited in the display area of the bank and controls payouts that are paid to players. The control device also interfaces with the gaming devices so that the gaming devices can signal the control device when a player has won a progressive prize. For example, if a particular wagering device awards a progressive prize, the wagering device signals the control device to dispense the progressive prize. The control device may then activate a dispensing device that dispenses the prize objects to the player.

Wagering devices that are physically connected to the bank may comprise a diverter that is adapted to divert coins or other prize objects used by the player to the bank. When a player places a wager in a wagering device, the coin may be diverted to a drop box, to a hopper in the wagering device, or to the bank. In this embodiment, a control mechanism is provided in the gaming device for controlling the diverter.

The progressive wagering system of the present invention may be designed to contribute only a small portion of each wager to progressive jackpots. Accordingly, a prize object contribution may only be made to the progressive jackpot when the accumulated value of current progressive contributions equals or exceeds the assigned value of the prize object. The control device is adapted to calculate when the accumulated value of the current contributions equals or exceeds this value and to control the deposit of the contribution in the visible area of the bank. The coin bank may also be provided with one or more storage hoppers for providing a reserve of prize objects. A deposit device may be provided for transporting prize objects from the hopper to the bank. The deposit device may comprise a conveyer belt or track of a type that is well known in the art.

The above description sets forth, rather broadly, the more important features of the present invention so that the detailed description of the preferred embodiment which follows may be better understood and contributions of the present invention to the art may be better appreciated. There are, of course, additional features of the invention that will be described below and which will form the subject matter of the claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

REFERENCE NUMERALS

Figure 1:
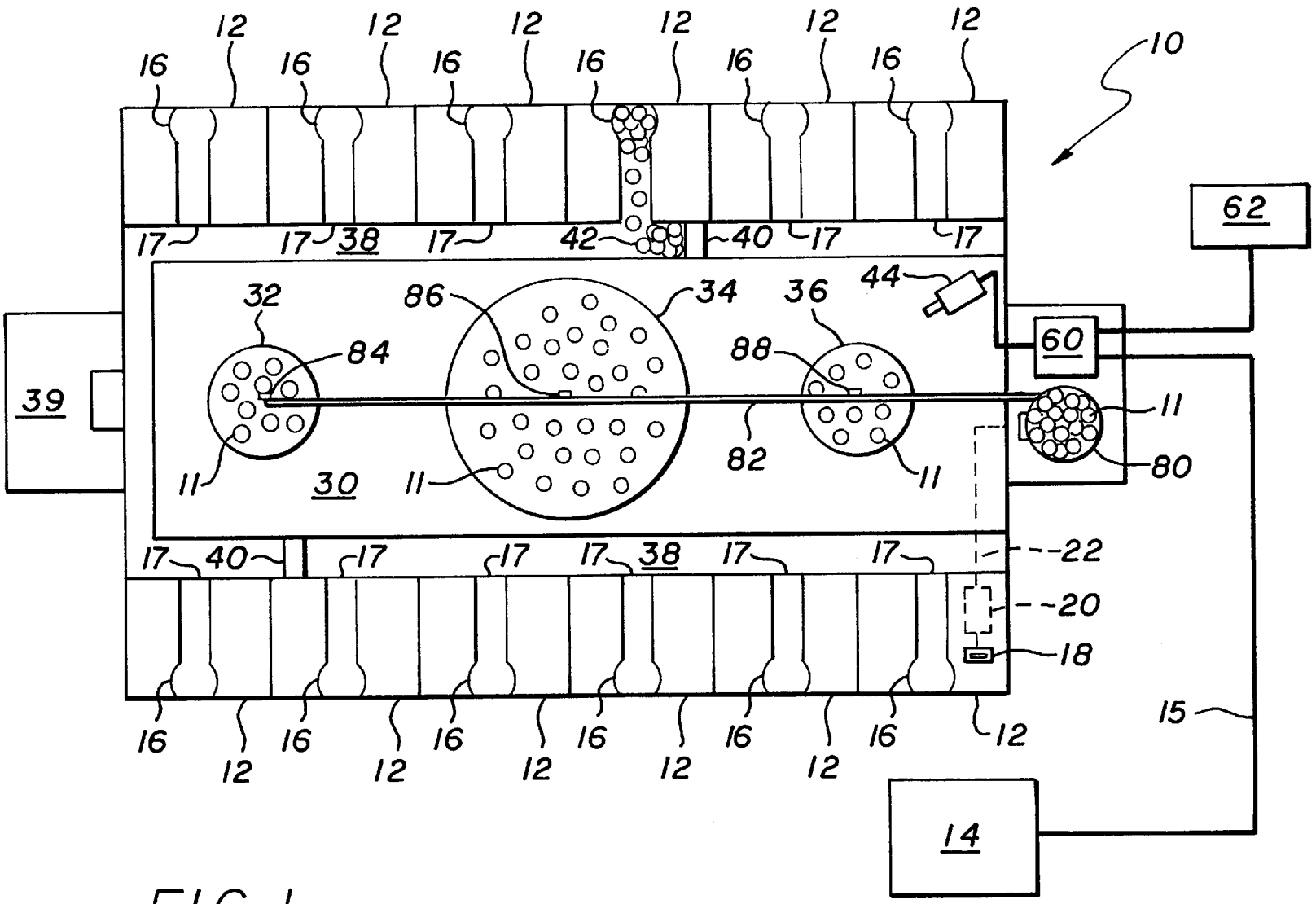
FIG. 1 is a schematic diagram of a progressive wagering system of the present invention.

10 system
11 prize objects

12 wagering device
14 remote wagering device
15 communication device
16 shoot
17 trap door or shoot door
18 slot
20 diverter
22 conveyer
30 bank
32 bin
34 bin
36 bin
38 gutter
39 container
40 moving device
42 prize objects
44 camera
60 control device
62 external device
80 hopper
82 conveyer
84 diverter
86 diverter
88 diverter
100 prize object
102 symbol

DESCRIPTION OF THE PREFERRED EMBODIMENT

As seen in FIG. 1, the present invention comprises a progressive wagering system generally indicated by reference numeral 10. System 10 comprises a plurality of wagering devices 12. The present invention may utilize any number of different wagering devices that are well known in the art. For example, wagering devices 12 may be spinning reel slot machines, video slot machines, video games, etc.

The present invention is designed to utilize tangible prize objects 11 to represent the value of a progressive prize. For example, prize objects may be coins, paper currency, tokens, toys, trinkets, jewelry, coupons, or vouchers. The present invention may be adapted to use any tangible object that is capable of representing value. The prize objects may be unique to system 10 so that they may only be used in system 10.

Figure 2:
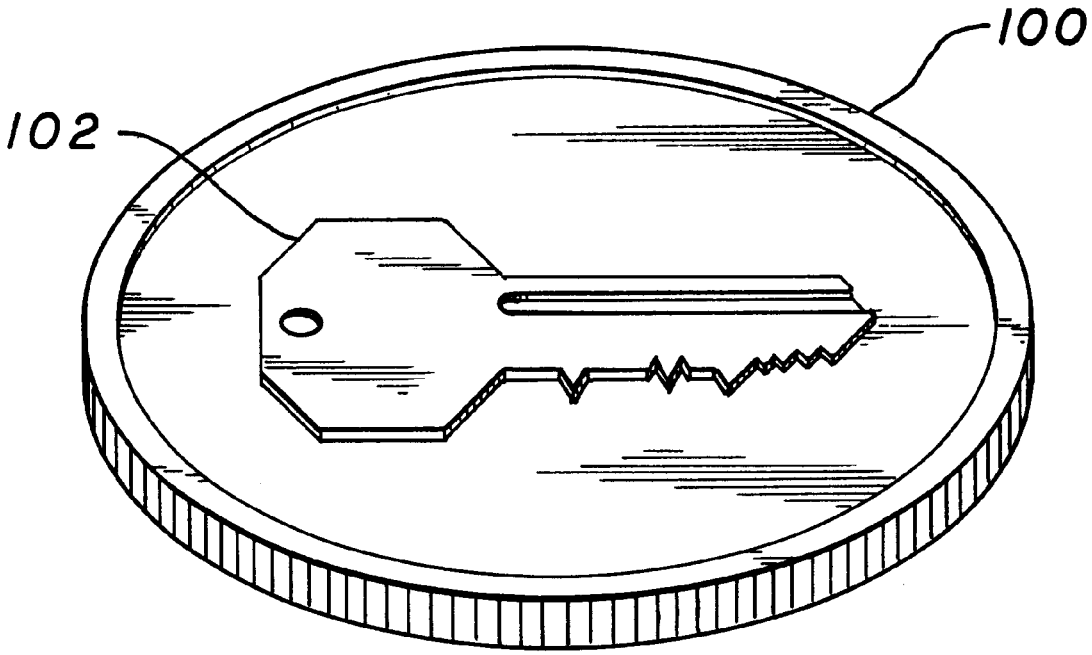
FIG. 2 is a perspective view of one possible prize object with a symbol representing a prize.

The prize objects are also capable of representing goods or services that cannot be physically displayed in bank 30. For example, a prize object may represent an automobile, a vacation package, or tickets to an entertainment event. When a prize object represents a good or service, a symbol of the good or service may be provided on the prize object to indicate its corresponding prize. As seen in FIG. 2, for example, a prize object 100 may be shaped like a coin to use existing equipment and technology for sorting, handling, and transporting coins. The object may have a symbol 102 for representing the represented prize. For example, symbol 102 may be a key representing an automobile, an airplane representing a vacation package, or tickets representing an entertainment event. In one embodiment of the present invention, prize object 100 is made of a translucent material and symbol 102 is a solid object imbedded in the material.

Prize objects representing goods and services may be used in the present invention together with prize objects representing monetary value. Thus, a progressive jackpot may comprise goods and services as well as monetary value. In those games in which jackpots are mixed, the different kinds of prize objects may have different appearances to allow players to distinguish between the different prizes. This may be accomplished by using different sizes, shapes, and colors. For example, prize objects representing a monetary value may be coin-shaped, gold-colored metal and prize objects representing goods or services may be translucent spheres with brightly colored symbols embedded in the spheres.

Prize objects may also represent only a portion of a good or service. This requires a player to collect more than one prize object representing the prize in order to win the prize. For example, a player may be required to collect 10 prize objects representing an automobile in order to win the automobile. This encourages players to continue to play the present invention if they have won less than the number of prize objects required to win the prize. This also allows the progressive wagering system to contribute a larger number of prize objects to the progressive jackpot over a given period of play because the assigned value of each prize object is small.

Progressive wagering system 10 also comprises a bank 30 for storing, displaying, and dispensing prize objects. Bank 30 comprises bins 32, 34, and 36 for holding prize objects. Bins 32, 34, and 36 may be different sizes to hold prizes of different values. Each coin bin may hold a separate progressive prize or the contents of the different coin bins may be combined to award a larger jackpot. For example, bins 32 and 36 may be combined to provide an intermediate jackpot and all three bins may be combined to provide the largest jackpot. The bins may be saucer-shaped, cylindrical, spherical, or any shape capable of holding prize objects. Preferably, the bins are translucent so that players can see the prize objects in the bins. Other objects and devices can be placed in bank 30 for enhancing visual stimulation. For example, waterfalls, ramps, and descending tracks may be used.

Bank 30 may also comprise means for dumping or emptying coin bins 32, 34, and 36. This may be accomplished by tilting the coin bins to one side or by providing trap doors in the bottoms or sides of the bins. Bank 30 may comprise gutters 38 for receiving the prize objects emptied from the bins. Each gutter 38 may have a moving device 40 for moving the prize objects to the appropriate wagering device 12. Moving devices 40 may be simple shovels or plows on tracks or they may be more complex devices such as scale models of vehicles. Each wagering device 12 may comprise a shoot 16 for receiving prize objects from gutter 38. A trap door or shoot door 17 may be used to allow prize objects 42 to enter shoot 16.

Bank 30 may also comprise a secure dispensing container 39 for receiving prize objects. When a large jackpot is awarded to a player it may be impractical to physically award the prize objects to the player. Furthermore, the owner/operator of the wagering system may be required to record information about the winning player and the size of the jackpot in order to comply with government regulations. In these instances, prize objects may be dispensed into container 39. An attendant with a key or other security device may then open container 39 to award the prize to the player under controlled circumstances. Alternatively, the player may be given a voucher and the prize objects may be returned to a hopper 80 or another storage device.

Wagering system 10 also comprises control device 60 for controlling system 10. Control device 60 may be a computer with software for operating bank 30 and communicating with wagering devices 12 and other devices.

Bank 30 may comprise a deposit device for depositing prize objects into bins 32, 34, and 36 of the bank. The deposit device may comprise storage hopper 80 for storing a reserve of prize objects. Hopper 80 may be filled periodically by a system operator or a diverter 20 may be provided in wagering devices 12 for diverting prize objects to hopper 80. Diverter 20 is connected to slot 18 and a conveyer 22. Coin slot 18 receives prize objects, such as coins, from players and conveyer 22 transports the objects to hopper 80. Diverter 20 may be programmed or controlled to divert a predetermined ratio of prize objects deposited into slot 18.

The deposit device of system 10 may also comprise a conveyer 82 for transporting prize objects from hopper 80 to bins 32, 34, and 36. Conveyers are well known in the art and many existing devices may be used in the present invention. Diverts 84, 86, and 88 may be used to divert prize objects into bins 32, 34, or 36, respectively.

System 10 may comprise one or more remote wagering devices 14. Unlike devices 12 that are physically connected to coin bank 30, wagering device 14 may be in any location. Wagering device 14 communicates with control device 60 through communication device 15.

Bank 30 may also comprise a camera 44 for transmitting images of the progressive jackpots to remote locations. This allows players at remote locations to view the jackpots. The images produced by camera 44 may be transmitted to control device 60 and control device 60 may transmit the images to remote wagering device 14 over communication device 15. Wagering device 14 may comprise a video screen for presenting the images.

Most progressive prizes operate by contributing a small portion of each wager to a progressive prize. Since the present invention utilizes objects of discrete value, a prize object may only be added to a progressive jackpot when the sum of current contributions equals or exceeds the representative value of the prize object. To accomplish this, control device 60 monitors and records wagers made by players at wagering devices 12 and calculates the value of contributions made to the progressive jackpots. When the value of the current contributions equals or exceeds the assigned value of a prize object, control device 60 may activate the deposit device to add a prize object to the progressive jackpot. Control device 60 may be programmed to deposit a mixture of different kinds of prize objects.

Control device 60 may also be adapted to control external device 62. Device 62 may be any external device associated with the wagering game, such as a meter, sign, speaker, or light For example, device 62 may be a video screen capable of graphically representing the value of the progressive jackpot. If the progressive jackpot comprises a physical prize, such as a car, device 62 can present an image of the car.

SUMMARY

It may now be seen from the above description that the present invention provides a novel progressive wagering system. The system comprises a plurality of wagering devices, a coin bank, and a control device. Tangible prize objects are used to visually display at least a portion of progressive jackpots. The present invention provides visual stimulation and increases the excitement and enjoyment experienced by players when they participate in the progressive wagering game.

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

What is claimed is:

1. A progressive wagering system comprising:

(A) a plurality of wagering devices for receiving wagers and playing at least one wagering game; and (B) a bank for displaying tangible prize objects, the prize objects representing at least a portion of a progressive jackpot, the bank comprising:

(a) a display area for displaying the tangible prize objects;

(b) a deposit device associated with said display area for depositing the tangible prize objects into said display area;

(c) a dispensing device associated with said display area for dispensing the tangible prize objects to the player; and (d) a control device in communication with said wagering devices, deposit device, and dispensing device.

2. The system of claim 1 further comprising a prize object transportation device for transporting prize objects from said wagering devices to said bank.

3. The system of claim 1 further comprising at least one hopper for storing a reserve of prize objects.

4. The system of claim 1 wherein said dispensing device comprises a prize object chute.

5. The system of claim 1 wherein said dispensing device comprises a prize object moving device for moving prize objects in said display area.

6. The system of claim 1 wherein said control device comprises means for calculating contributions to the progressive jackpot based upon wagers placed with said wagering devices.

7. The system of claim 1 further comprising a meter in communication with said control device for displaying the value of the progressive jackpot.

8. The system of claim 1 further comprising means for generating sounds.

9. The system of claim 1 further comprising a display device for graphically displaying goods or services in said progressive jackpot.

10. The system of claim 1 further comprising a camera in said bank, said camera being adapted to transmit images of prize objects in said bank.

11. The system of claim 1 further comprising at least one bin in said bank for holding prize objects.

12. A progressive wagering system, comprising:

(A) a plurality of wagering devices, the wagering devices being adapted to accept wagers from players and allow players to play at least one wagering game;

(B) a plurality of tangible prize objects, the tangible prize objects being capable of representing value;

(C) a bank, the bank being adapted to store, display, and dispense the tangible prize objects representing at least a portion of a progressive jackpot, the progressive jackpot being available for a player to wager on and play for, the bank comprising:

(a) a display area, the display area being adapted to display the tangible prize objects deposited in the bank, wherein players may view the tangible prize objects;

(b) a deposit device, the deposit device being adapted to deposit prize objects in the display area;

(c) a dispensing device, the dispensing device being adapted to dispense the tangible prize objects in the display area to a player; and (D) means for monitoring wagers placed in the wagering devices;

(E) means for calculating a contribution to a progressive jackpot;

(F) means for activating the deposit device to deposit at least one tangible prize object into the display area, the tangible prize object deposited into the display area representing at least a portion of the contribution to the progressive jackpot.

13. The system of claim 12 wherein the dispensing device comprises a prize object chute, wherein prize objects may slide from the display area to a player.

14. The system of claim 12 wherein the bank further comprises a prize object moving device, the prize object moving device being adapted to move prize objects within the bank.

15. The system of claim 12 further comprising a prize object transportation device, the prize object transportation device being adapted to transport prize objects from the wagering devices to the bank.

16. The system of claim 12 wherein at least one of the prize objects represents monetary value.

17. The system of claim 12 wherein at least one of the prize objects represents at least a portion of a good or service.

18. The system of claim 12 wherein at least one of the prize objects comprises a symbol representing a good or service.

19. The system of claim 12 further comprising a secured compartment, the secured compartment being adapted to hold prize objects that have been awarded to a player.

20. The method of claim 12 further comprising the step of dispensing prize objects to a player.

21. The method of claim 12 further comprising the step of storing a reserve of prize objects.

22. A method of displaying a progressive jackpot, method comprising the following steps:

(A) providing a plurality of wagering devices, the wagering devices being adapted to receive wagers;

(B) providing a plurality of tangible prize objects, the tangible prize objects being adapted to represent value;

(C) providing a bank, the bank being adapted to store, display, and dispense at least one tangible prize object, the prize object representing at least a portion of a progressive jackpot available for a player to wager on and play for;

(D) calculating a progressive jackpot contribution, the contribution being in a predetermined relationship to wagers placed in the wagering devices;

(E) depositing at least one tangible prize object in the bank, the prize object representing at least a portion of the progressive jackpot contribution;

(F) displaying the tangible prize object in the bank, wherein at least one player may view the tangible prize object in the bank; and (G) allowing at least one player to place at least one wager in at least one of the wagering devices to play for the progressive jackpot displayed in the bank.

* * * * *